US005520565A

United States Patent [19]

Ulysse

[11] Patent Number: 5,520,565

[45] Date of Patent: May 28, 1996

[54] TOY FLYING DISC

[76] Inventor: Clark Ulysse, 6930-54th Ave. No., #201, Crystal, Minn. 55428

[21] Appl. No.: 401,624

[22] Filed: Mar. 9, 1995

[51] Int. Cl.[6] ..... A63H 27/00; A63H 27/127

[52] U.S. Cl. ..... 446/46; 446/36; 446/61; 244/23 C; 244/154; D12/335; D12/325; D21/85

[58] Field of Search ..... 446/46, 47, 48, 446/34, 36, 61, 66; 244/12.2, 23 C, 34, 39, 153 R, 154; D12/335, 325; D21/85, 86, 82

[56] References Cited

U.S. PATENT DOCUMENTS

| | | | |
|---|---|---|---|
| D. 157,652 | 3/1950 | Whitehurst | 244/154 X |
| 2,659,178 | 12/1950 | Hartesveldt . | |
| 2,717,131 | 9/1955 | Barrett | 244/6 |
| 3,246,425 | 4/1966 | Miller | 446/61 |
| 4,209,936 | 7/1980 | Skiar . | |
| 4,452,410 | 6/1984 | Everett | 244/23 C X |
| 4,515,570 | 5/1985 | Beltran | 446/47 |
| 4,846,749 | 7/1989 | Petko . | |
| 5,259,802 | 11/1993 | Yang | 446/46 |
| 5,324,223 | 6/1994 | Yang . | |

FOREIGN PATENT DOCUMENTS

| | | | |
|---|---|---|---|
| 0032292 | 7/1981 | European Pat. Off. | 446/36 |
| 1400474 | 7/1975 | United Kingdom | 446/46 |

*Primary Examiner*—Mickey Yu
*Assistant Examiner*—D. Neal Muir
*Attorney, Agent, or Firm*—Leo Gregory

[57] ABSTRACT

A flying toy disc with a pivoted fuselage, the disc flying spinning in flight upon being thrust with a forward spinning motion, the disc having a particular transverse configuration which taken with the pivoted fuselage tends to stabilize the flight of the disc by having air streams co-act upon the lower and upper surface of the disc to stabilize the flight.

3 Claims, 2 Drawing Sheets

TOY FLYING DISC

BACKGROUND OF THE INVENTION

1. Field of Invention

This invention is a toy flying disc having a particular construction to result in improved stability of flight and direction in flight.

2. Description of the Prior Art

Whirling or flying discs are a popular toy and a principal object has been the effort to stabilize the flight and thus lengthen the extents of flight.

In reference to U.S. Pat. No. 2,659,178, the disc is denominated to be a saucer and represents an inverted bowl having a substantially flat top portion formed as a dome having a non-rotatable underlying floor having an outwardly extending rudder which retains the floor plate against rotation.

In U.S. Pat. No. 4,209,936 a flying saucer is disclosed with a flexible pivoted tail which tends to oscillate with the saucer in flight and trail in a direction opposite to that of flight.

In U.S. Pat. No. 4,846,749 a saucer like device is disclosed having an overhead centrally mounted propellor having an adjustable pitch of the blades.

Reference is also had to U.S. Pat. No. 5,324,223 disclosing a flying toy comprising a disc having overhead a toy aircraft having an operable fan which in its rotation allegedly aids in the flight of the disc.

SUMMARY OF THE INVENTION

A principal object of this invention is to provide a toy flying disc having superior flying qualities which embody superior stability and operating controls.

It is a particular object of this invention to provide a disc particularly configured to cause the passing air currents to impose a stabilizing pressure on the disc.

It is a further object to pivot a fuselage section to said disc having a particularly devised pivot to connect the two, said pivot having an enlarged washer between said fuselage and disc to stabilize the same and with the fuselage having a tail section directionally adjustable to cause said disc to pursue a particular course such as a circular course.

It is another object to transversely configure the disc and particularly the rim portion thereof whereby the air streams passing therethrough engage the upper and lower facing surfaces of said rim portion to cause the same to be stabilized to insure a longer flight and cause the disc to be responsive to the directional control of the tail piece.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
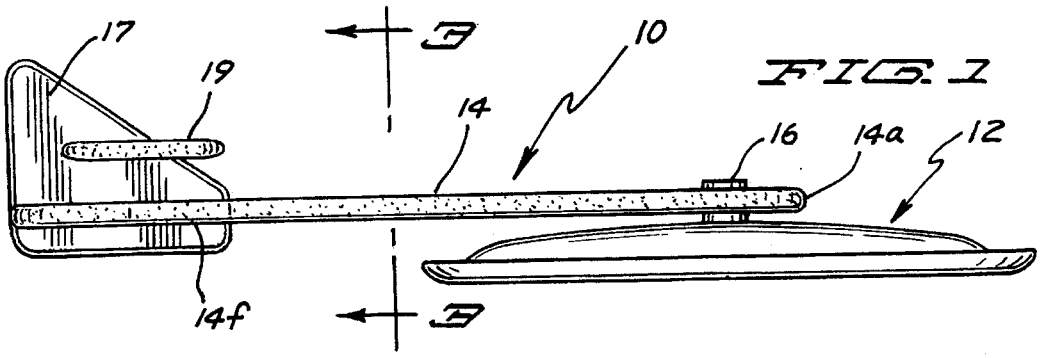
FIG. 1 is a view in side elevation.
Figure 2:
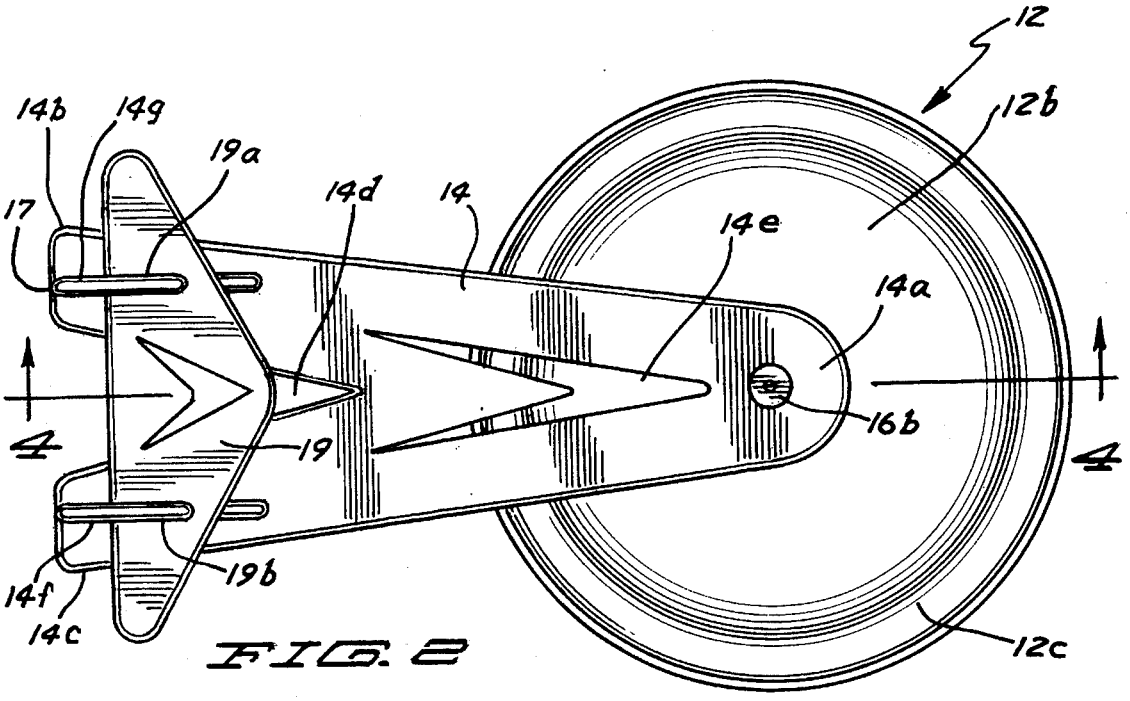
FIG. 2 is a top plan view.

With particular reference to FIGS. 1 and 2, the device comprising the invention herein is indicated by the reference numeral 10 and includes a disc 12 having a tail section or fuselage 14 pivoted thereto by a pivot 16.

Figure 4:
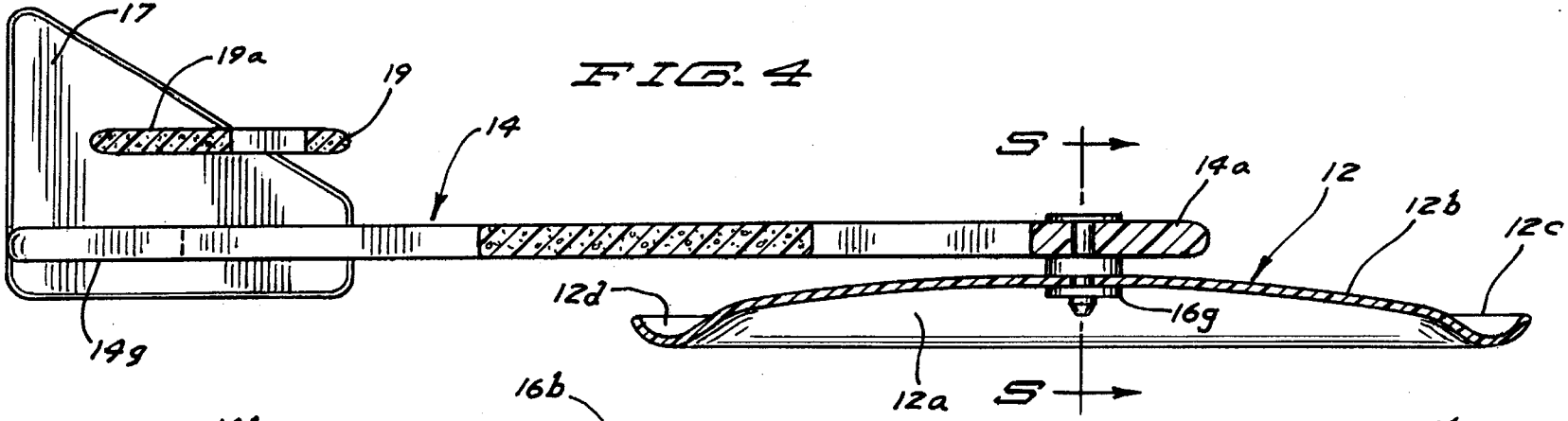
FIG. 4 is a vertical longitudinal section taken on line 4—4 of FIG. 2 as indicated.

Referring now particularly to FIG. 4, the disc 12 is saucer like in form and is shown in an inverted or upside down position having a concave bowl **12*a* forming a convex upwardly facing top portion 12*b* and having formed thereabout a circular upturned perimeter or edge portion 12*c* having formed between it and said convex top portion a concave circular passage or rim flange 12*d***.

Extending outwardly of said disc 12 and pivoted thereto, as will be described, is a fuselage or tail section 14. Said fuselage as shown in plan in FIG. 2, is plate like in form having a front end nose section **14*a* here shown as being rounded and said fuselage extends rearwardly widening transversely having rearward transversely spaced end portions or tail sections 14*b* and 14*c* having a V-shaped separation 14*d* therebetween. Forwardly of said V-shaped separation 14*d* is a V-shaped opening 14*e***.

Figure 3:
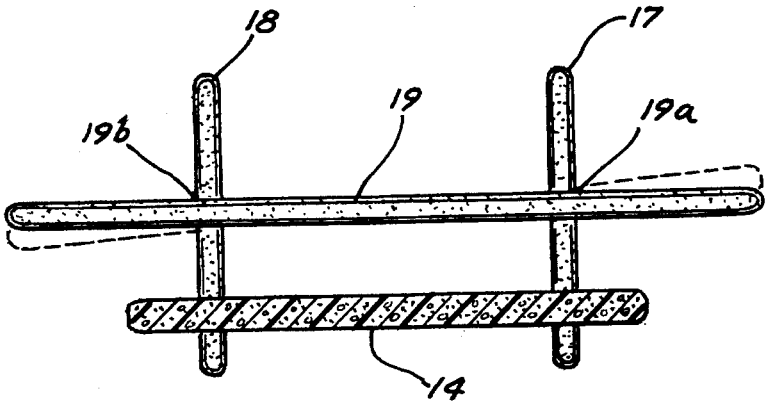
FIG. 3 is a view in cross section taken on line 3—3 of FIG. 1 as indicated.

Upstanding centrally longitudinally from each of said end portions or tail sections are substantially triangular upstanding rudder members 17 and 18, said tail sections being respectively slotted at **14*f* and 14*g* to receive therein said rudders, the rudders being secured as with a suitable adhesive not shown. Carried by said rudders and extending thereacross horizontally is an elevating member 19 which is shown being triangular in plan. Said elevating member is slotted as at 19*a* and 19*b* being disposed to respectively receive in said slots said rudders 17 and 18. The slots are tightly fit said rudders but permit vertical movement or tilted movement of said elevating member thereon as indicated in FIG. 3**. The tilting of said elevating member causes the device to define a particular flight pattern.

Figure 6:
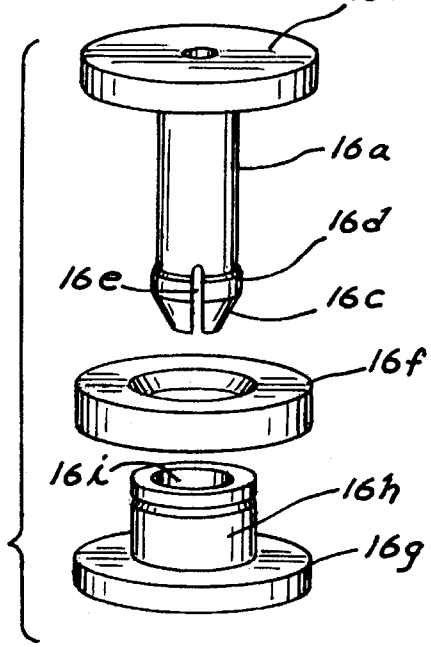
FIG. 6 is an enlarged expanded view of a pivot structure.
Figure 5:
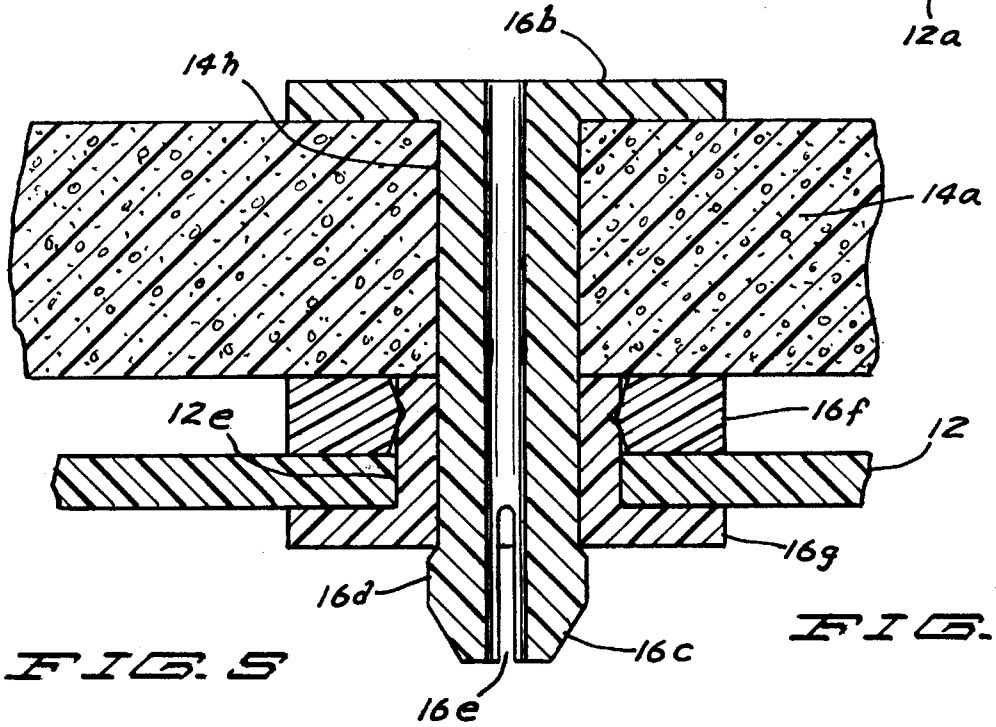
FIG. 5 is a view in cross section taken on line 5—5 of FIG. 4 as indicated.

Referring now to the pivot 16 which connects said fuselage and said disc, said pivot as shown in FIGS. 5 and 6 is disposed through a front end central vertical opening or hole **14*h* in said fuselage and through the central opening 12*e* in said dics. Said pivot comprises a stem 16*a* having an enlarged circular flange like head portion 16*b* and a split tapered bottom end portion 16*c* having a slightly enlarged collar 16*d* and an upward extending slot 16*e* from said bottom end portion, the same being somewhat yielding to be compressible. Said stem is disposed through said slot 14*h* in said fuselage and placed onto said stem underlying said fuselage is a collar 16*f* which is oversized to provide a supporting surface for said fuselage, said stem is then disposed through the hole 12*e* into the base of said pivot which comprises a bottom collar 16*g* having upstanding therefrom a stub sleeve 16*h* having therethrough a hole 16*i* through which is disposed the bottom portion 16*c* of said stem 16*a*, said collar 16*f* being compressed in being squeezed through said hole 16*i* and through the collar 16*g* to expand thereunder for a secure hold as shown in FIG. 5**.

OPERATION

Referring to the drawings, the device 12 is contoured having a concave underside resulting in a convex upper facing side and adjacent to the perimeter of the upper facing side is a concave passage. The effect thereof upon an airstream thereover with the device in flight is to stabilize the device for flying horizontally for a greater distance than otherwise.

The pivot 16 connecting said disc and the fuselage (FIGS. 4 and 5) has a fairly substantial washer 16*f* disposed therebetween to maintain the fuselage in a horizontal position relative to the general plane of the disc.

The fuselage has a unique function whereby it pivots very readily to always be trailing said disc in flight and it affects the direction of the flight of the disc.

At the tail end section of the fuselage is the elevating means 19 which is carried by the pair of spaced rudders 17 and 18 and is attached to said rudders to be tiltable as indicated in FIG. 3. The tilt causes the device when launched by a forward thrust to pursue a circular course.

The fuselage being formed to be platelike and flared in width rearwardly has significant influence in causing said device to have an extended horizontal flight.

The underlying concavity and the overlying convexity of the disc appear to reduce air friction to a nominal amount causing considerable improvement in extending flight movement.

It will of course be understood that various changes may be made in the form, details and arrangement of the device comprising the invention such as discussed and defined in the appended claims.

What is claimed is:

1. A toy flying eisc comprising a saucer-like dusc, a fuselage, pivot means attaching said fuselage to said disc, said fuselage being adapted to trail said disc by means of said pivot and adapted to trail said disc in flight, said fuselage is v-shaped in plan having transversely widening spaced rear end portions providing a v-shaped separation, each rear end portions each having an upstanding triangular rudder, an elevating means being transversely disposed horizontally across said rudders, and means securing said elevating means to said rudders to permit tilting positioning of said elevating means to define a course of travel of said disc.

2. A toy flying disc comprising a saucer-like disc, said disc comprising a concave downwardly facing bowl and having a convex upwardly facing top, said disc having a circular perimeter defining a concave passage about said convex top, a v-shaped unitary fuselage, pivot means pivoting said fuselage with said disc centrally thereof, said fuselage extends rearwardly having transversely v-spaced tail end portions having a v-spacing therebetween, said end portions each having an upstanding rudder, a horizontally disposed elevating member carried by said rudders, and said elevating member adapted to be tilted to define a flight pattern of said disc.

3. A toy flying disc comprising a saucer-like disc, a v-shaped fuselage in plan, pivot means attaching said fuselage to said disc, said fuselage being adapted to trail said disc in flight, said fuselage having transversely widening v-spaced rear end portions, each rear end portion each having an upstanding rudder, a horizontally disposed elevating member carried by said rudders, said elevating member engaging said rudders to be tiltable with respect thereto, and said tilted position of said elevating member determining a course of flight of said disc.

* * * * *